US010307021B2

(12) United States Patent
Han

(10) Patent No.: US 10,307,021 B2
(45) Date of Patent: Jun. 4, 2019

(54) KNOCK DOWN AND NESTING SHOWER CADDY

(71) Applicant: Barenthal North America, Inc., Whippany, NJ (US)

(72) Inventor: Hongyuan Han, New Vernon, NJ (US)

(73) Assignee: Barenthan North America, Inc., Whippany, NJ (US)

( * ) Notice: Subject to any disclaimer, the term of this patent is extended or adjusted under 35 U.S.C. 154(b) by 0 days.

(21) Appl. No.: 15/805,669

(22) Filed: Nov. 7, 2017

(65) Prior Publication Data

US 2018/0125306 A1 May 10, 2018

Related U.S. Application Data

(60) Provisional application No. 62/419,144, filed on Nov. 8, 2016.

(51) Int. Cl.
*A47K 3/28* (2006.01)
*A47B 47/00* (2006.01)
*A47B 81/00* (2006.01)

(52) U.S. Cl.
CPC ..... *A47K 3/281* (2013.01); *A47B 47/00* (2013.01); *A47B 81/00* (2013.01)

(58) Field of Classification Search
CPC ..... A47K 3/281; A47B 47/00; A47B 81/00; B65D 21/04; B65D 21/041
USPC ..... 206/504, 505, 515, 517, 518, 519, 520; 211/126.7, 126.8
See application file for complete search history.

(56) References Cited

U.S. PATENT DOCUMENTS 4,573,591 A * 3/1986 Chap ..... A47K 3/281 211/113
5,724,894 A * 3/1998 Knorovsky ..... A47B 81/002 108/42
5,911,396 A * 6/1999 Bireley ..... G10G 5/00 211/113
D417,990 S * 12/1999 Yemini ..... D6/525
D494,793 S * 8/2004 Winkleman ..... A47K 3/281 D6/525
D494,794 S * 8/2004 Winkleman ..... A47K 3/281 D6/525
D496,549 S * 9/2004 Snell ..... A47K 3/281 D6/525
D632,515 S * 2/2011 Cittadino ..... A47K 3/281 D6/525
9,357,860 B1 * 6/2016 Klowan ..... A47K 3/281
9,999,322 B2 * 6/2018 Hain ..... A47K 3/281
(Continued)

*Primary Examiner* — Stanton L Krycinski
(74) *Attorney, Agent, or Firm* — Preti Flaherty Beliveau & Pachios LLP

(57) ABSTRACT

A shower caddy with a knock down or telescoping frame is described. For shipment, on retailer shelves and while on display, the shower caddy can be maintained in a closed configuration. In this configuration, the total volume required for each unit is significantly less than when the frame is in an extended or open configuration, such as when configured for use. This leads to lower shipping costs because the volume required by plural units is reduced, lower storage costs because more units may be stored by a distributor or retailer as compared to a unitary item, and greater convenience to a consumer since the item is more easily transported to the home and may be more easily stored when not in use.

18 Claims, 7 Drawing Sheets

(56) References Cited

U.S. PATENT DOCUMENTS

| | | | | |
|---|---|---|---|---|
| 2007/0045208 | A1* | 3/2007 | Quan | A47K 3/281<br>211/119 |
| 2008/0169254 | A1* | 7/2008 | Govrik | A47K 3/281<br>211/103 |

* cited by examiner

KNOCK DOWN AND NESTING SHOWER CADDY

STATEMENT REGARDING FEDERALLY SPONSORED RESEARCH OR DEVELOPMENT

N/A

BACKGROUND OF THE INVENTION

Various embodiments relate generally to shower caddies and, more specifically, relate to knockdown shower caddies.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Consumer goods such as plastic shower caddies are typically molded as a single, unitary piece. This simplifies the process of fabrication. Shower caddies may also be made from metal wire alone or in combination with plastic, bamboo or other materials. A typical shower caddy of conventional configuration comprises a substantially rectangular frame, a receptacle typically dimensioned to hold several bottles, such as shampoo, conditioner, body wash, etc., and optionally a soap dish. The receptacle and soap dish are disposed within the rectangular frame and project outwards on a common side of the frame. In use, the top of the rectangular frame is disposed over an object projecting from a wall. Most commonly, the object is a pipe to which a shower head is attached. The rectangular frame is then proximate the shower enclosure wall and the receptacle and soap dish project outwards, away from the wall and towards a user.

However, a single piece consumer product such as a unitary shower caddy suffers from several drawbacks. First, an elongated frame means the product itself requires a larger amount of space for storage and display in a retail setting. Thus, a retailer is able to stock and display fewer products per unit volume. Second, an elongated frame results in a more cumbersome product for transportation and storage by a consumer. Third, a fixed, elongated frame necessitates larger product packaging. Fourth, such a frame means fewer finished products may be shipped per unit volume from a manufacturer to a distributor and to the retailer. Finally, an elongated frame increases the risk of breakage during shipment, on display in a retail setting, and during transportation by a consumer. Collectively, these drawbacks mean higher costs for the manufacturer, distributor, and retailer, a more expensive product for the consumer, and a less resilient product.

BRIEF SUMMARY OF THE INVENTION

The below summary is merely representative and non-limiting.

The above problems are overcome, and other advantages may be realized, by the use of the embodiments.

In order to address the above identified issues, the present disclosure includes a shower caddy with a knock down or telescoping frame. For shipment, on retailer shelves and while on display, the novel shower caddy is preferably maintained in a closed configuration. In this configuration, the total volume required for each unit is significantly less than when the frame is in an extended or open configuration, such as when configured for use. This leads to lower shipping costs because the volume required by plural units is reduced, lower storage costs because more units may be stored by a distributor or retailer as compared to a unitary item, and greater convenience to a consumer since the item is more easily transported to the home and may be more easily stored when not in use.

The telescopic functionality may be achieved by providing two frame portions: an upper portion and a lower portion, with free, downwardly projecting ends of the upper portion being received within free, upwardly projecting ends of the lower portion. Each of the open and closed configurations is maintained through frictional engagement between the two portions. Such frictional engagement may be the result of mechanical interference between one or more elements, including a projection on an outer surface of the upper portion that is received within a receptacle on an inner surface of the lower portion. Alternatively, the projection may be on the inner surface of the lower portion, and the receptacle may be on the outer surface of the upper portion. A single projection on each side of the frame may be employed with two or more respective receptacles, each receptacle for maintaining the two portions in respective configurations. Other means of maintaining the relative positions of the two portions may be employed, or none may be employed.

A variety of ornamental features may be applied to or in one or more portions of the presently disclosed shower caddy without departing from the telescoping concept. Additional features may also be provided, including small hooks projecting from one or both frame portions. One or more features may be provided in conjunction with the frame for enabling installation over a shower pipe.

BRIEF DESCRIPTION OF THE SEVERAL VIEWS OF THE DRAWINGS

Aspects of the described embodiments are more evident in the following description, when read in conjunction with the attached Figures.

DETAILED DESCRIPTION OF THE INVENTION

This patent application claims priority from US Provisional Patent Application No. 62/419,144, filed Nov. 8, 2016, the disclosure of which is incorporated by reference herein in its entirety.

FIGS. 1-6 and 13-16 depict a first ornamental embodiment 10 of a knock down or telescoping shower caddy according to the present disclosure, while FIGS. 7-12 depict a second ornamental embodiment 110.

Figure 1:
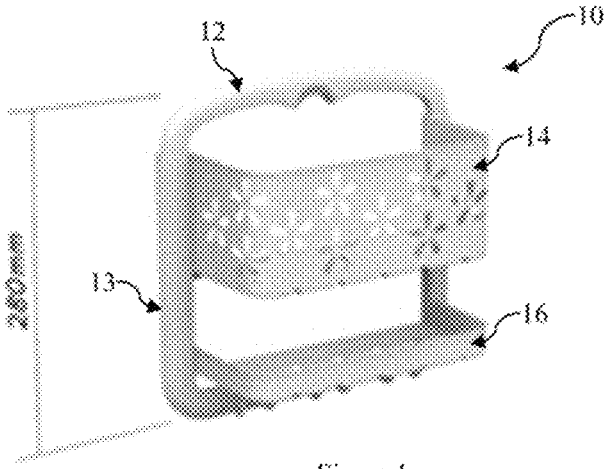
FIG. 1 is a perspective view of a first embodiment of a shower caddy having a telescoping frame according to the present disclosure, the frame being in a closed configuration.
Figure 2:
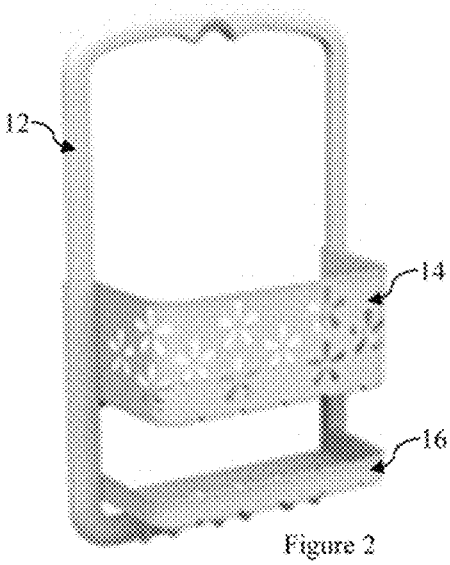
FIG. 2 is a perspective view of a first embodiment of a shower caddy having a telescoping frame according to the present disclosure, the frame being in an open configuration.

In FIG. 1, the first ornamental embodiment of the presently disclosed shower caddy is shown in a first closed configuration, suitable for shipment, storage and/or retail display. A portion of each side of an upper frame portion 12, also referred to as downwardly projecting free ends, is disposed within a respective side of a lower frame portion 13, also referred to as upwardly projecting free ends. The receptacle 14 is affixed to the lower frame portion, as is a soap tray 16. At an upper end of the upper frame portion, laterally in the middle of the frame, a feature 20 is provided for disposing the frame over a member projecting horizontally from a vertical wall surface of a shower enclosure, such as a pipe to which a shower head is fitted. As shown, the feature is a rubberized notch, the rubber inhibiting a tendency for the frame to slide on the pipe. The feature is frusto-circular with dimensions selected to be roughly the same as the diameter of a typical shower head pipe.

The receptacle 14 in an illustrative embodiment is provided with perforations arranged in a pattern that is pleasing from a design perspective. The perforations also reduce weight and reduce the quantity of material required to fabricate the shower caddy, thus reducing cost, without sacrificing the integrity of the receptacle. Further still, the perforations facilitate airflow within the receptacle, thus enhancing water evaporation and inhibiting the growth of mold or fungus on the receptacle floor. While not visible in the figures, the floor of the receptacle may also be provided with perforations for the same reasons.

Figure 4:
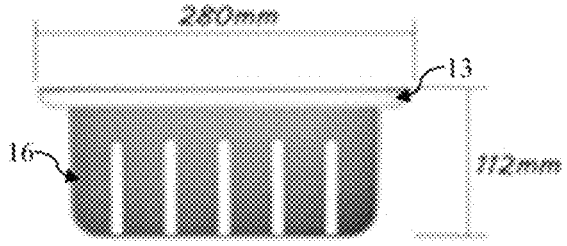
FIG. 4 is a bottom plan view of the shower caddy of FIGS. 1 and 2 with illustrative but not limiting dimensions.
Figure 5:
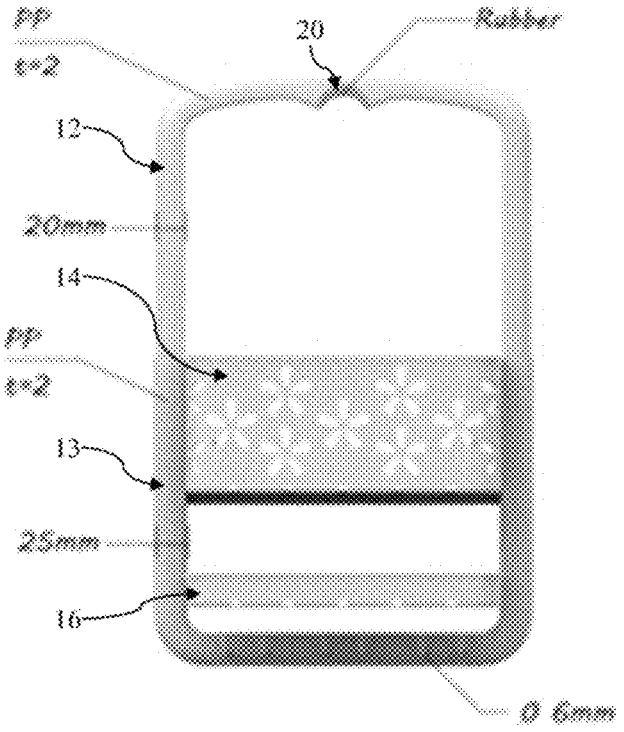
FIG. 5 is a front elevation view of the shower caddy of FIGS. 2 and 3.

The soap dish 16 in the illustrative embodiment is also provided with perforations, as particularly visible in FIG. 4. Preferably, the perforations enable water to drain away from a bar of soap so as to prolong the life of the soap.

In FIGS. 2, 3, 5, and 6, the first ornamental embodiment 10 of the telescoping shower caddy is shown in a second open configuration, suitable for use in a consumer shower enclosure. In this configuration, a smaller extent of each side of the upper frame portion 12 is disposed within a respective side of the lower frame portion 13, such that the overall frame length is greater than that when the frame is in the closed configuration, as in FIG. 1.

Exemplary and non-limiting dimensions for the illustrative embodiment are shown in FIGS. 1, 4, 5, and 6. In the closed configuration, the illustrated shower caddy 10 is approximately 280 mm in height, whereas in the open position, the shower caddy is 438 mm in height, with a distance of 210 mm from the top of the receptacle to the top of the extended frame, 100 mm in receptacle height, and 58 mm between the bottom of the receptacle and the top of the soap dish. The width of the shower caddy is 280 mm, or the same dimension as the height in the closed configuration. The depth of the receptacle 14 and soap dish 16, including the lower frame portion 13, is approximately 112 mm. The upper frame portion is approximately 20 mm wide and is provided in the illustrative embodiment as having a semicircular cross-section and solid surface in a forward direction visible to a user. The upper section is approximately 15 mm in depth. The lower frame portion is approximately 25 mm in width and also has a semicircular cross-section, and a solid surface in a forward direction.

Figure 6:
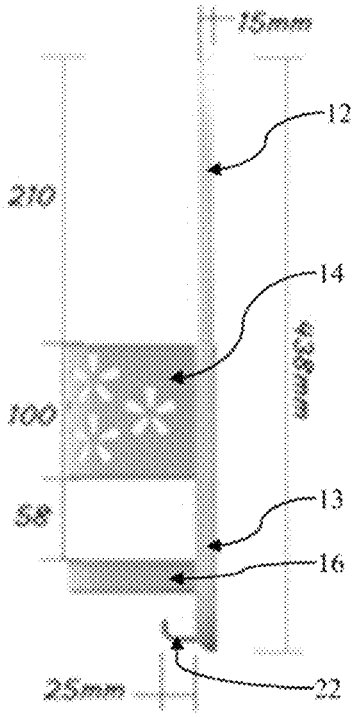
FIG. 6 is a side elevation view of the shower caddy of FIG. 5.
Figure 7:
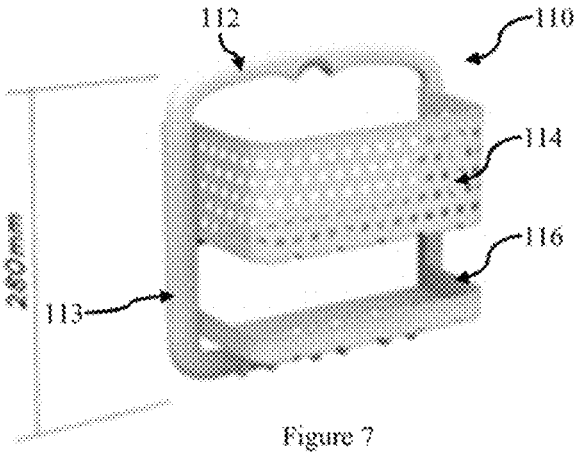
FIG. 7 is a perspective view of a second decorative embodiment of a shower caddy having a telescoping frame according to the present disclosure, the frame being in a closed configuration.
Figure 8:
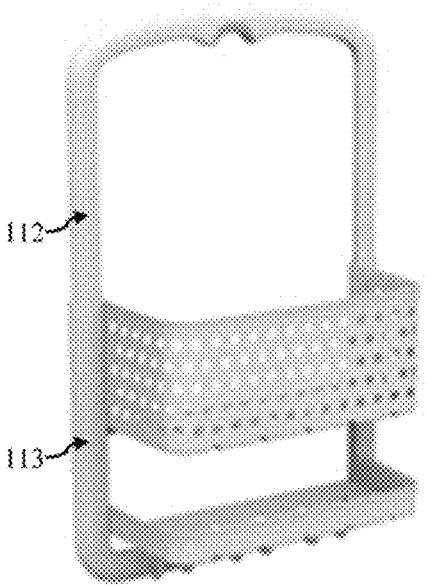
FIG. 8 is a perspective view of a second decorative embodiment of a shower caddy having a telescoping frame according to the present disclosure, the frame being in an open configuration.
Figure 9:
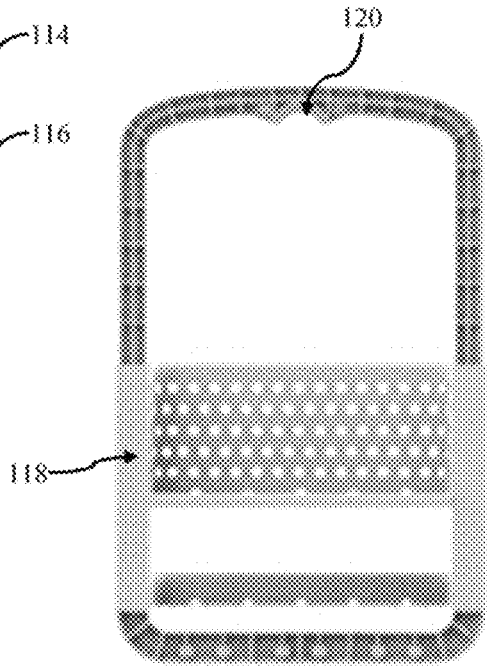
FIG. 9 is a rear elevation view of the shower caddy of FIGS. 7 and 8, the frame being in the open configuration.
Figure 10:
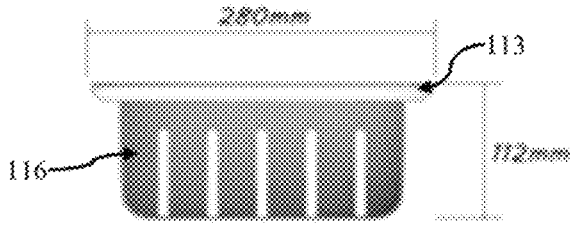
FIG. 10 is a bottom plan view of the shower caddy of FIGS. 7 and 8 with illustrative but not limiting dimensions.
Figure 11:
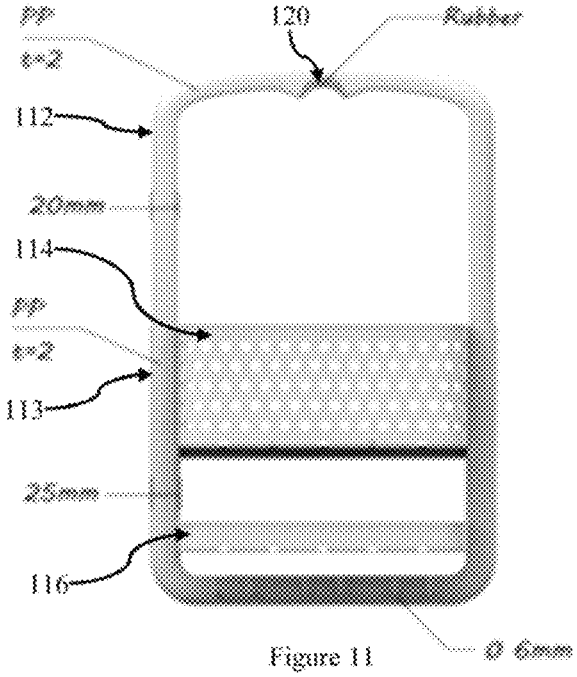
FIG. 11 is a front elevation view of the shower caddy of FIGS. 8 and 9.
Figure 12:
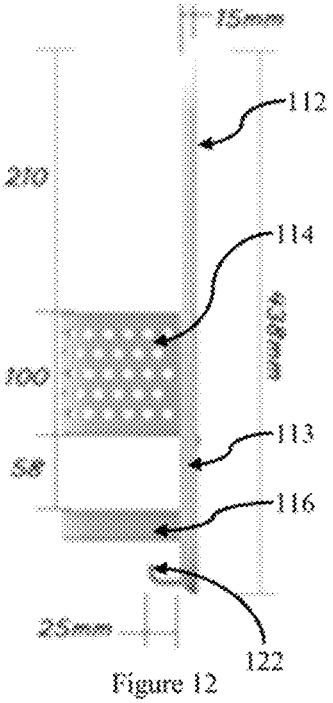
FIG. 12 is a side elevation view of the shower caddy of FIG. 11.

As seen in FIG. 6, one or more utility hooks 22 may be provided, extending from the lower frame portion 13. As shown, the hook is approximately 25 mm in depth. Six such hooks are visible in the embodiment of FIG. 5, under the soap dish 16. Such hooks may be for wash cloths, scrub brushes having strings for hanging, etc. Portions of the hooks are visible in FIGS. 1 and 2.

Figure 3:
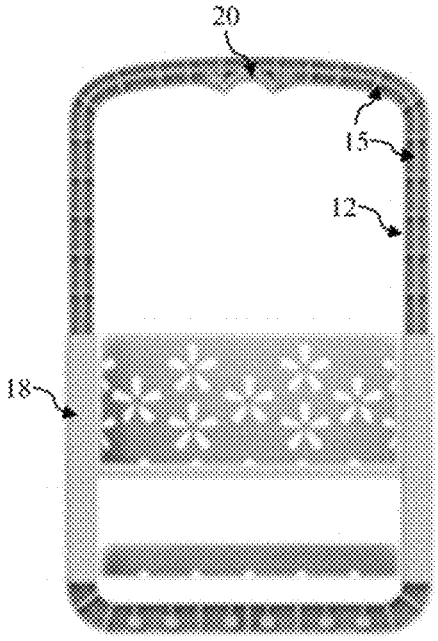
FIG. 3 is a rear elevation view of the shower caddy of FIGS. 1 and 2, the frame being in the open configuration.

In FIG. 3, the rearward-facing part of the upper frame portion 12, the side of the upper frame portion facing the shower enclosure wall, is shown to be open. Visible are supporting ribs 15 used to add strength and resiliency to the frame. The absence of a covering surface reduces weight, reduces the material requirement, and reduces the tendency for water to accumulate within the frame.

Figure 13:
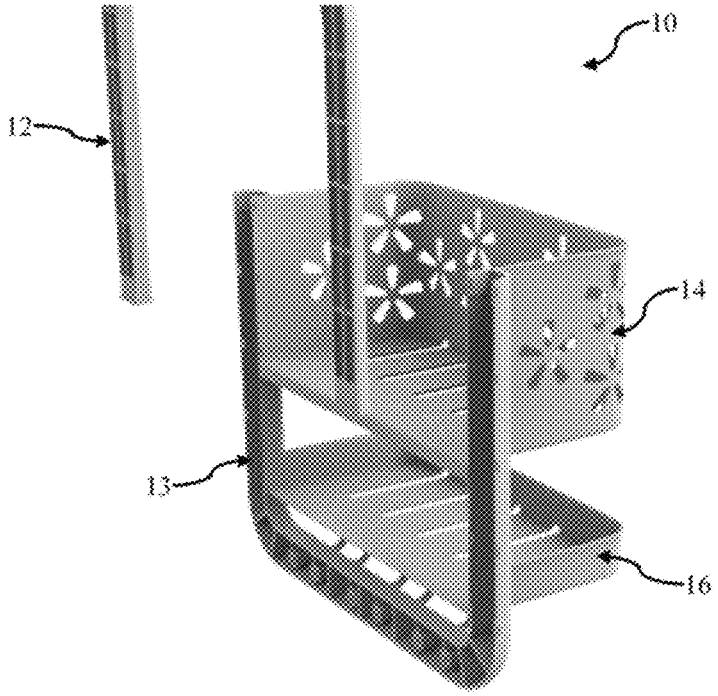
FIG. 13 is a rear-side perspective partial view of the shower caddy of FIGS. 1 and 2 in which an upper frame portion and a lower frame portion are separated prior to assembly.
Figure 14:
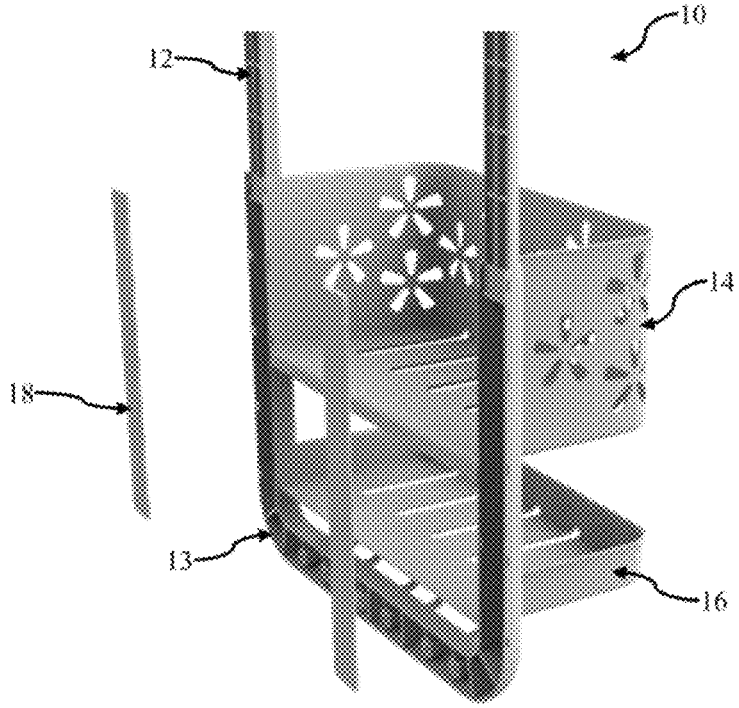
FIG. 14 is a rear-side perspective partial view of the shower caddy of FIG. 14 in which the upper frame portion and the lower frame portion are assembled and with rear cover portions not yet assembled.
Figure 15:
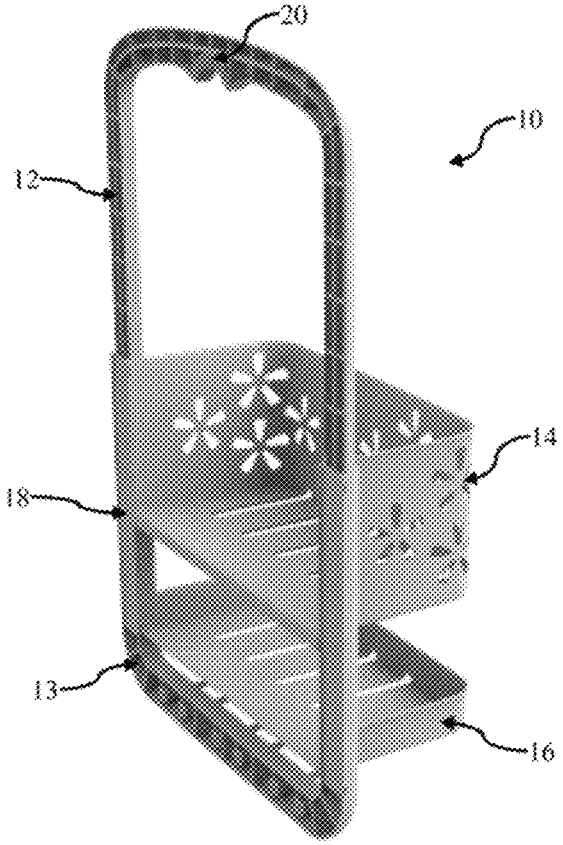
FIG. 15 is a rear-side perspective view of the assembled shower caddy of FIGS. 13 and 14.

Retaining plates 18 are affixed over the lower frame portion in FIG. 3, entraining at least a part of the upper frame portion therein. Assembly of the upper and lower frame portions is depicted in FIGS. 13-15. Free ends of the upper frame portion 12 are disposed within respective free ends of the lower frame portion 13, as shown in FIG. 14. Retaining plates 18 are then affixed to the rearward facing surfaces of the lower frame portion, such as through ultrasonic welding, gluing, or other commonly practiced techniques. The upper frame portion free ends are thus capable of sliding within the lower frame portion free ends, behind the retaining plates.

Optionally, mechanical features may be provided on the upper frame free ends and lower frame free ends for maintaining the relative position between the two portions. For example, the upper frame free ends may each have one or more mechanical features projecting from an outer surface thereof, and the lower frame free ends may have one or more complimentary mechanical features on an interior surface thereof that selectively cooperate with those on the upper frame free ends. As an example, the mechanical features may be slight protrusions and apertures for receiving the protrusions. Force imparting relative motion between the upper and lower portions causes a slight deformation of the member bearing the protrusion as it is drawn out of the respective aperture. Once the protrusion is aligned with another aperture, the member relaxes as the protrusion enters the aperture and is retained therein.

Alternatively, no mechanical features are provided on the upper and lower frame portions. In such an embodiment, the frame is free is slide between the closed configuration and the open configuration. In use, the shower caddy is in the open configuration. Thus, the weight of shampoo or conditioner bottles in the receptacle or soap in the soap tray will tend to keep the shower caddy in the open, use configuration.

FIGS. 7-12 depict a second decorative embodiment 110 of the telescoping shower caddy shown in FIGS. 1-6, the sole difference being the use of a different aperture shape and pattern on the receptacle 114. The upper frame portion 112, lower frame portion 113, receptacle 114, soap dish 116, retaining plates 118, shower head pipe interface 120 and optional utility hook(s) 122 are essentially the same as those employed in the first embodiment 10. Other decorative apertures may be employed, or none at all.

The components of the presently disclosed telescoping shower caddy are fabricated from polypropylene in an illustrative embodiment, with the addition of a resilient material such as rubber for the shower head pipe feature 20. Other suitable materials may be employed.

Figure 16:
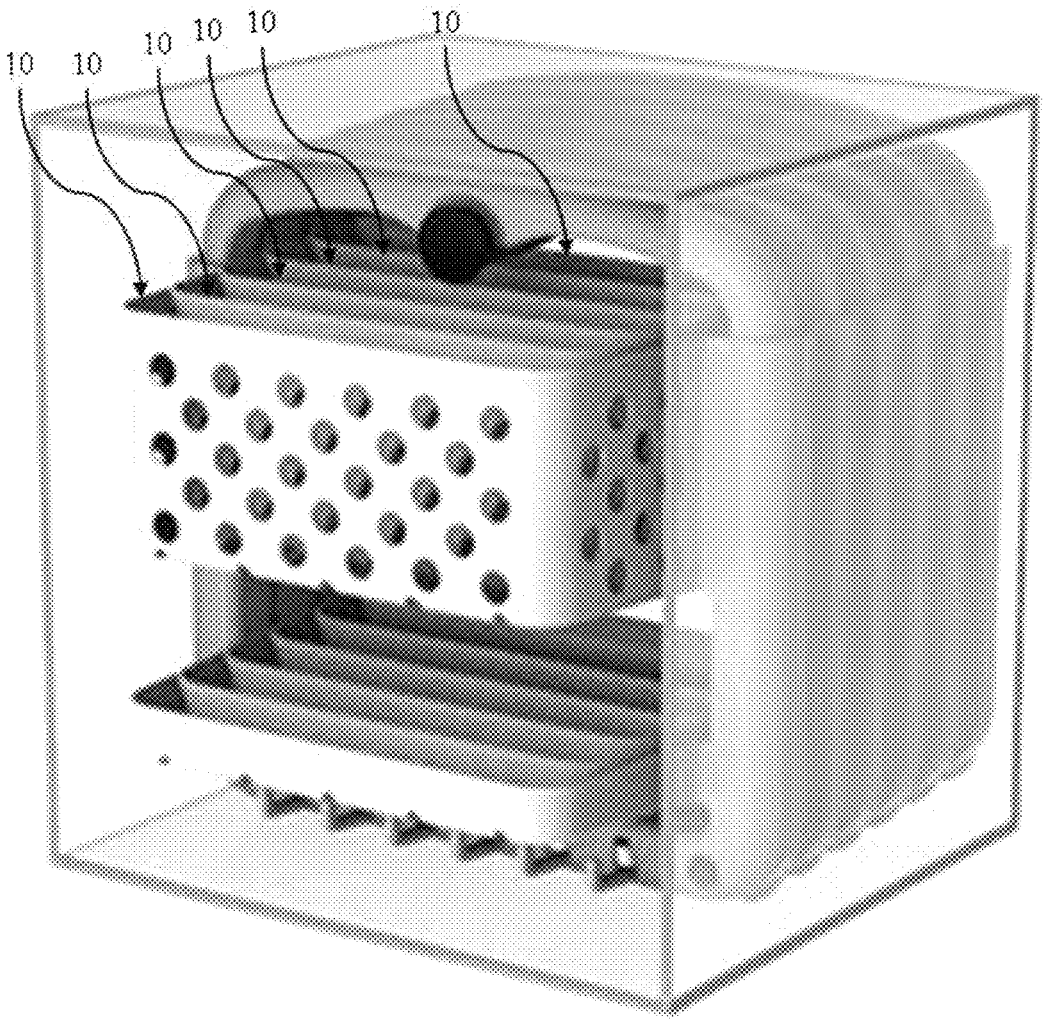
FIG. 16 provides an illustration of how six units of the shower caddy in accordance with an embodiment can be nested for shipment with illustrative but not limiting dimensions.

A major advantage of a knock down or telescopic shower caddy, as previously described, is the ability to package a number of units in a smaller volume for shipment or storage as compared to the volume required for a prior art unitary shower caddy. In FIG. 16, this is illustrated. Here, six telescopic shower caddy units 10 are nested together, each with a respective upper frame portion disposed within the lower frame portion in the closed configuration. Each of the receptacles 14 and soap dishes 16 may be slightly narrowed, widthwise, from the frame outwards. This facilitates the nesting shown in FIG. 16. Of course, more or less than six units may be packaged together in this manner. As illustrated, the collapsed height of the combined units is the same as the width, or 290 mm. Collectively, the six units are 327 mm deep. Other dimensions are employable.

The foregoing description has been directed to particular embodiments. However, other variations and modifications may be made to the described embodiments, with the attainment of some or all of their advantages. Modifications to the above-described systems may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

Many changes in the details, materials, and arrangement of parts and steps, herein described and illustrated, can be made by those skilled in the art in light of teachings contained hereinabove. Accordingly, it will be understood that the scope of the invention is not to be limited to the embodiments disclosed herein and can include practices other than those specifically described, and are to be interpreted as broadly as allowed under the law.

What is claimed is:

1. A shower caddy comprising:

a frame having an upper frame portion and a lower frame portion; and at least one dish unitary with the lower frame portion and configured to nest with an associated at least one dish of another, said shower caddy, wherein the upper frame portion and the lower frame portion are configured to move from an open position and a closed position, the shower caddy having a first volume in the closed position and a second, larger volume in the open position.

2. The shower caddy of claim 1, wherein the upper frame portion comprises upper portion ends, the lower frame portion comprises lower portion ends, and the upper portion ends are configured to be received in the lower portion ends.

3. The shower caddy of claim 1, wherein the upper frame portion comprises upper portion ends, the lower frame portion comprises lower portion ends, and the lower portion ends are configured to be received in the upper portion ends.

4. The shower caddy of claim 1, wherein the upper frame portion and the lower frame portion are maintained in at least one of the open position and the closed position by frictional engagement of the upper frame portion and the lower frame portion.

5. The shower caddy of claim 1, wherein the upper frame portion comprises at least one projection, and the lower frame portion comprises at least one receptacle, each of the at least one receptacle is configured to receive an associated projection of the at least one projection.

6. The shower caddy of claim 1, wherein the lower frame portion comprises at least one projection, and the upper frame portion comprises at least one receptacle, each of the at least one receptacle is configured to receive an associated projection of the at least one projection.

7. The shower caddy of claim 1, wherein the at least one dish comprises a first portion proximal to the lower frame portion and a second portion distal to the lower frame portion, the first portion being wider than the second portion.

8. The shower caddy of claim 1, wherein one dish of the at least one dish comprises at least one of: slots and perforations.

9. The shower caddy of claim 1, wherein the upper frame portion comprises a hanging portion configured to hang vertically from a horizontal shower pipe.

10. The shower caddy of claim 9, wherein the hanging portion comprises a rubberized notch.

11. The shower caddy of claim 9, wherein the hanging portion comprises a frustro-circular feature having dimensions selected to be substantially equivalent to a diameter of a shower head pipe.

12. The shower caddy of claim 1, wherein at least one of: the upper frame portion and the lower frame portion comprise supporting ribs.

13. The shower caddy of claim 1, wherein the shower caddy comprises polypropylene.

14. The shower caddy of claim 1, wherein the at least one dish comprises:

a shelf that is substantially perpendicular to the lower frame portion and a wall that is substantially parallel to the lower frame portion.

15. The shower caddy of claim 14, wherein the wall comprises perforations.

16. A caddy comprising:

a frame having an upper frame portion and a lower frame portion; and at least one dish unitary with the lower frame portion, the at least one dish having a first portion proximal to the lower frame portion and a second portion distal to the lower frame portion, the first portion being wider than the second portion such that the at least one dish is configured to nest with an associated at least one dish of another, said caddy by inserting the second portion of the at least one dish through the first portion of the associated at least one dish of another, said caddy, wherein the upper frame portion and the lower frame portion are configured to move from an open position and a closed position, the shower caddy having a first volume in the closed position and a second, larger volume in the open position, and the upper frame portion comprises a hanging portion configured to hang vertically from a horizontal pipe.

17. The caddy of claim 16, wherein the upper frame portion comprises upper portion ends, the lower frame portion comprises lower portion ends, and the upper portion ends are configured to be received in the lower portion ends.

18. The caddy of claim 16, wherein the upper frame portion comprises upper portion ends, the lower frame portion comprises lower portion ends, and the lower portion ends are configured to be received in the upper portion ends.

* * * * *